US010676335B1

(12) United States Patent
Sickler et al.

(10) Patent No.: US 10,676,335 B1
(45) Date of Patent: Jun. 9, 2020

(54) DIESEL EXHAUST FLUID FUNNEL

(71) Applicant: Hopkins Manufacturing Corporation, Emporia, KS (US)

(72) Inventors: Vicki Sickler, Emporia, KS (US); David D. McCormick, Kansas City, MO (US)

(73) Assignee: Hopkins Manufacturing Corporation, Emporia, KS (US)

( * ) Notice: Subject to any disclaimer, the term of this patent is extended or adjusted under 35 U.S.C. 154(b) by 11 days.

(21) Appl. No.: 16/175,172

(22) Filed: Oct. 30, 2018

(51) Int. Cl.
*B67C 11/02* (2006.01)

(52) U.S. Cl.
CPC ..... *B67C 11/02* (2013.01)

(58) Field of Classification Search
CPC B67C 11/02; B67C 2011/30; B67C 2011/027
USPC ..... 141/331–347
See application file for complete search history.

(56) References Cited

U.S. PATENT DOCUMENTS 1,487,824 A * 3/1924 Vincent ..... B67C 11/02 141/297
2011/0011488 A1* 1/2011 Sickler ..... B67C 11/02 141/1
2013/0340882 A1* 12/2013 Ehrbar ..... G01G 23/00 141/1
2016/0192973 A1* 7/2016 Shimko ..... A61F 2/28 141/2

* cited by examiner

*Primary Examiner* — Timothy P. Kelly
(74) *Attorney, Agent, or Firm* — Hovey Williaims LLP

(57) ABSTRACT

A fluid funnel includes an open-topped mouth for receiving DEF or other liquids from a jug or other source; an elongated hollow stem depending from the mouth for directing the fluids from the mouth into a DEF tank or other fluid receptacle; and a tapered throat that joins the mouth and stem. The funnel more effectively direct fluids into a tank, even when the funnel is tilted; inhibits fluids from backing-up into the mouth and/or spilling out of the funnel; prevents displaced air from bubbling up through fluids in the mouth; and more firmly engages and seats within a tank port.

24 Claims, 9 Drawing Sheets

DIESEL EXHAUST FLUID FUNNEL

BACKGROUND

The present invention relates to fluid-filling funnels, and more particularly, to funnels used for filling vehicle tanks and other receptacles with diesel exhaust fluid (DEF).

DEF is an emission control fluid that is sprayed into the exhaust stream of diesel engines to break down dangerous NOx emissions into harmless nitrogen and water. DEF is not a fuel additive and never comes into contact with diesel fuel, so it must be stored separately from diesel fuel. Some fueling stations provide DEF at the pump, but it's more typically purchased in 1-4 gallon jugs and then poured into vehicle DEF tanks by hand.

The filling ports of DEF tanks are typically installed in cramped locations (either next to diesel fuel ports or under vehicles' hoods) and are therefore difficult to reach. Because of the remote locations of DEF tank ports and the weight and bulkiness of DEF jugs, DEF is often spilled during filling. Funnels can be used to reduce spilling, but conventional fluid funnels are designed for filling easier-to-reach fuel, oil, and liquid coolant ports and don't work as well for hard-to-reach DEF ports. Moreover, most vehicle DEF ports are inclined, making them even more difficult to reach and fill with funnels.

The amount of DEF consumed by a diesel engine varies from vehicle-to-vehicle, but typical passenger vehicles consume approximately 1 gallon of DEF per every 200 miles driven. Because of this high consumption rate and the relatively low-volume of most DEF tanks, such tanks must be filled frequently, exasperating the above-described filling problems.

Accordingly, there is a need for an improved fluid funnel that more effectively assists with the filling of DEF tanks.

SUMMARY

The present invention solves the above-described problems and other problems by providing an improved fluid funnel specifically designed for filling DEF tanks. A fluid funnel constructed in accordance with an embodiment of the invention broadly comprises an open-topped mouth for receiving fluids from a jug or other source and an elongated hollow stem depending from the mouth for directing the fluids from the mouth into a DEF port or other fluid receptacle. The funnel includes numerous unique features that individually and collectively reduce spilling, fluid back-ups, bubbling from displaced air, and other related problems.

One feature of the funnel ensures all DEF poured in the mouth will drain into the stem and into a DEF tank rather than remaining in or spilling out of the funnel. Conventional funnels work well when they are oriented vertically, with their mouths directly above their stems. But funnels often must be tilted to reach remote and/or inclined DEF tank ports. When tilted too far, funnel mouths slope away from their stems, thus causing fluids to remain in or spill out of the mouths rather than flowing to and through their stems. The funnel of the present invention solves this problem by cooperatively configuring the slope of the walls in the mouth with the slope of the stem. In particular, in one embodiment, the mouth has a lowermost sloped wall that is no more than 40 degrees offset from the stem. This ensures the mouth slopes toward the stem even when the funnel is tilted up to 50 degrees relative to a vertical axis to ensure all DEF poured in the mouth will flow to the stem and into the DEF tank in which the funnel is inserted. Other sloped walls in the mouth are offset even less than 40 degrees vs. the stem to hold DEF in the mouth even when the funnel is tilted more than 50 degrees.

Another related feature of the funnel increases the rate at which DEF drains through the stem and into a DEF tank rather than remaining in or spilling out of the funnel. Many conventional funnels have stems with circular cross sections that form nearly air-tight seals with the DEF tank ports in which they are placed. When DEF is poured in the funnels, air in the DEF tanks is displaced by the incoming DEF and bubbles up through the DEF, slowing the rate at which the DEF may enter the tanks. The funnel of the present invention solves this problem by forming the stem with grooves or slots on its exterior surface. These grooves form air channels between the exterior of the stem and the DEF port to allow displaced air to escape around the outside of the stem rather than through DEF poured into the funnel.

Another feature of the funnel provides a larger area to capture poured fluid when the funnel is tilted. The effective pour-capture surface area (the surface area of the mouth in plan view) of conventional funnels decreases proportionally as the funnels are tilted. Thus, the more these prior art funnels are tilted, the more difficult it is to aim fluids into their mouths. The funnel of the present invention solves this problem by providing an effective pour-capture surface area that increases as the funnel is tilted. In one embodiment, the effective pour-capture area of the mouth is maximized at nearly 17 sq. inches when the funnel is tilted approximately 35 degrees, thus easing the filling of DEF ports that are inclined and/or difficult to reach.

Another feature of the funnel ensures it is properly anchored and stable in a DEF tank port during filling. Many prior art funnels have narrow stems to ensure they will fit in any sized filling port. These narrow stems don't fully engage the interior surfaces of some filling ports, causing the funnels to slip and move when touched, often resulting in fluid spills. These narrow stems also don't provide an adequate fluid flow path, often causing fluids to back-up in their mouths and spill from the funnels. Some prior art funnels attempt to solve this problem by providing tapered stems that are narrow at their tips and wider where they connect to their mouths. But the stems of many of these funnels are either tapered too much, such that their tips can't be inserted far enough into a DEF port, causing the funnels to slip and move when touched, or are tapered too little, such that their tips extend too far into a DEF port, which positions their mouths too close to the DEF ports where they are difficult to reach. The funnel of the present invention solves this problem by tapering the stem an optimal amount such that its tip can be inserted far enough into a DEF port to stabilize the funnel but not so far that the mouth of the funnel is too close to the DEF port. In one embodiment, the stem is tapered such that its outside diameter is approximately equal to the inside diameter of a standard DEF port at a distance of 1.5 inches from the tip of stem. This allows the stem to be inserted 1.5 inches into a standard DEF fluid port to provide adequate anchoring while also maintaining an optimal distance between the mouth of the funnel and the DEF port. This tapering also provides a sufficient fluid flow path through the tip of the stem and allows multiple funnels to be stacked for easier transport and storage.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
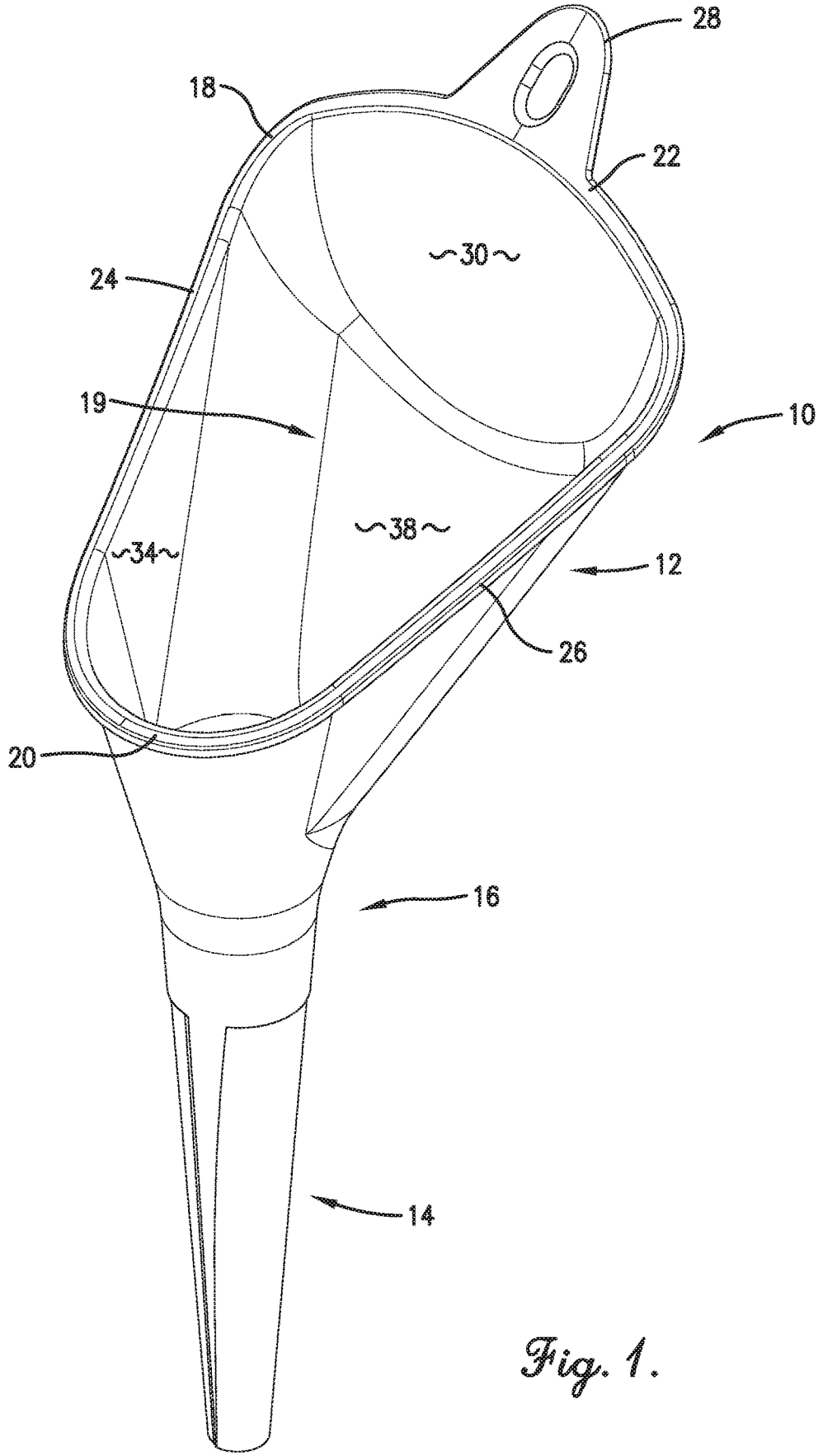
FIG. 1 is an upper perspective view of a funnel constructed in accordance with embodiments of the present invention.
Figure 2:
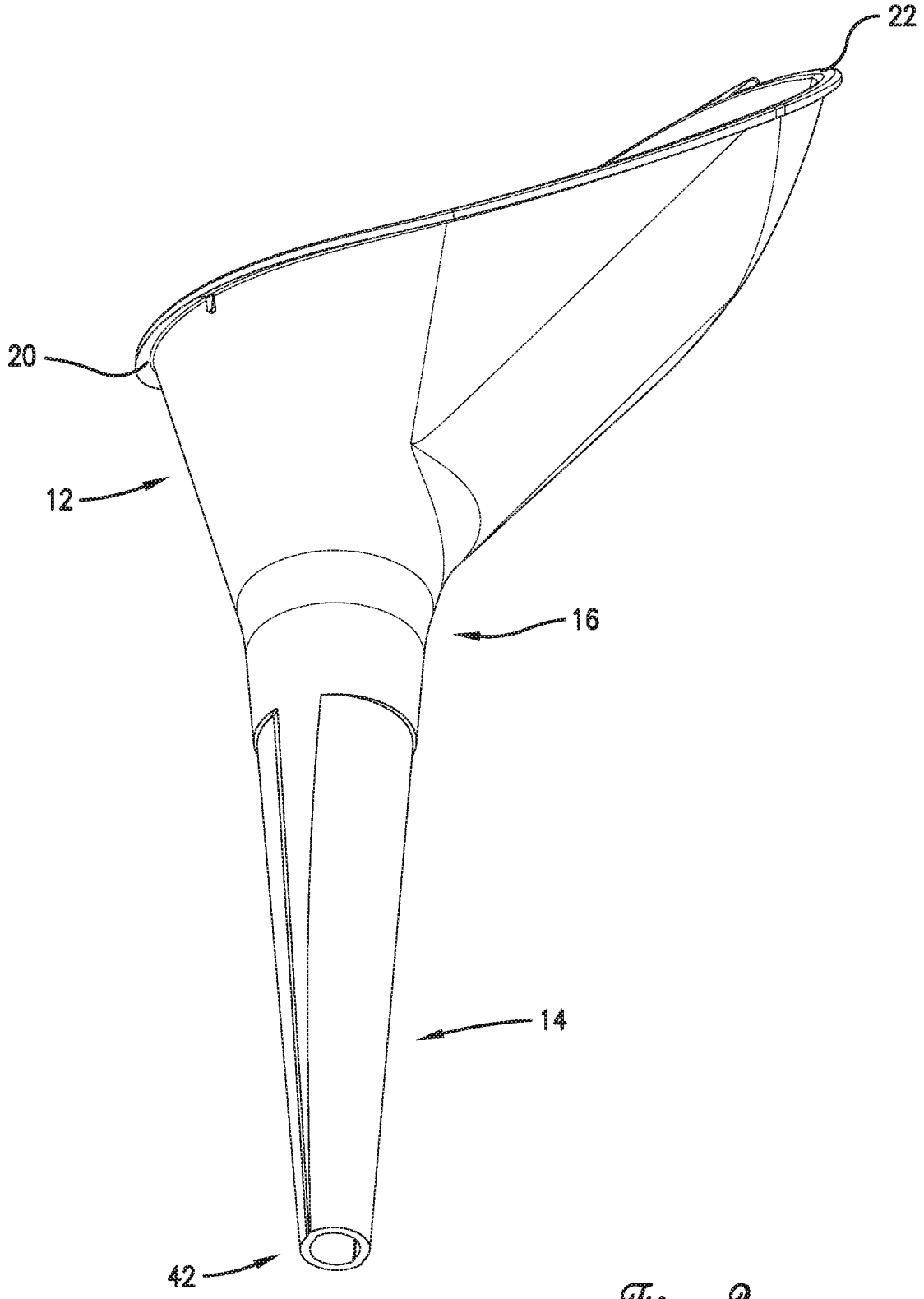
FIG. 2 is a lower perspective view of the funnel.

The drawing figures do not limit the present invention to the specific embodiments disclosed and described herein. The drawings are not necessarily to scale, emphasis instead being placed upon clearly illustrating the principles of the invention.

DETAILED DESCRIPTION

The present invention provides a fluid funnel with a number of features that individually and collectively ease the filling of DEF tanks and other fluid receptacles. A funnel constructed in accordance with embodiments of the invention more effectively directs fluids into a tank, even when the funnel is tilted; inhibits fluids from backing-up into the funnel and/or spilling out of the funnel; reduces the tendency of displaced air from bubbling up through fluids in the funnel; and more firmly engages and seats within a tank port to eliminate unwanted funnel movement during filling.

An embodiment of the funnel is especially designed and configured for filling DEF into vehicle tanks, but other embodiments may be used for filling any fluids into any fluid receptacles. The funnel may be formed of plastics or any other suitable materials such as metal, glass, fiberglass, paper, or cardboard.

Specific embodiments of the funnel will now be described with reference to the attached drawing figures. Referring initially to FIG. 1, an embodiment of the funnel 10 broadly comprises an open-topped mouth 12 for receiving fluids from a jug or other source; an elongated hollow stem 14 depending from the mouth for directing the fluids from the mouth into a tank or other fluid receptacle; and a tapered throat 16 that joins the mouth 12 and stem 14. Each portion of the funnel will now be described in more detail below.

The mouth 12 includes an upper rim 18 that defines a pour-capture opening 19 for receiving DEF fluids or other fluids from a jug or other container. As best illustrated in FIG. 1, the rim 18 has a front section 20, an opposite rear section 22, and left and right side sections 24, 26. A hang tab 28 may extend from the rear section 22 for use in hanging the funnel on a display rack, hook, or other device.

Figure 3:
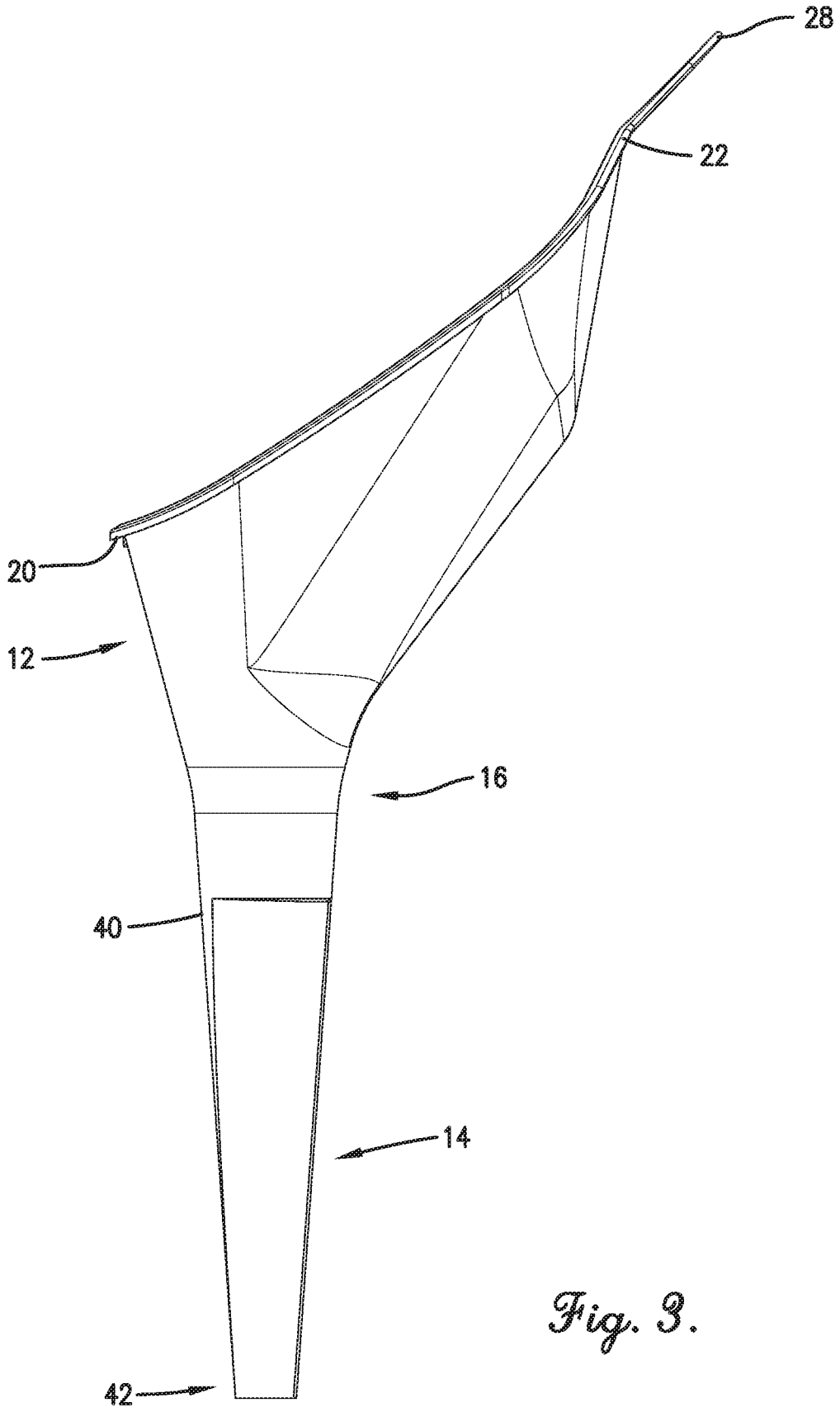
FIG. 3 is a side elevational view of the funnel.
Figure 7:
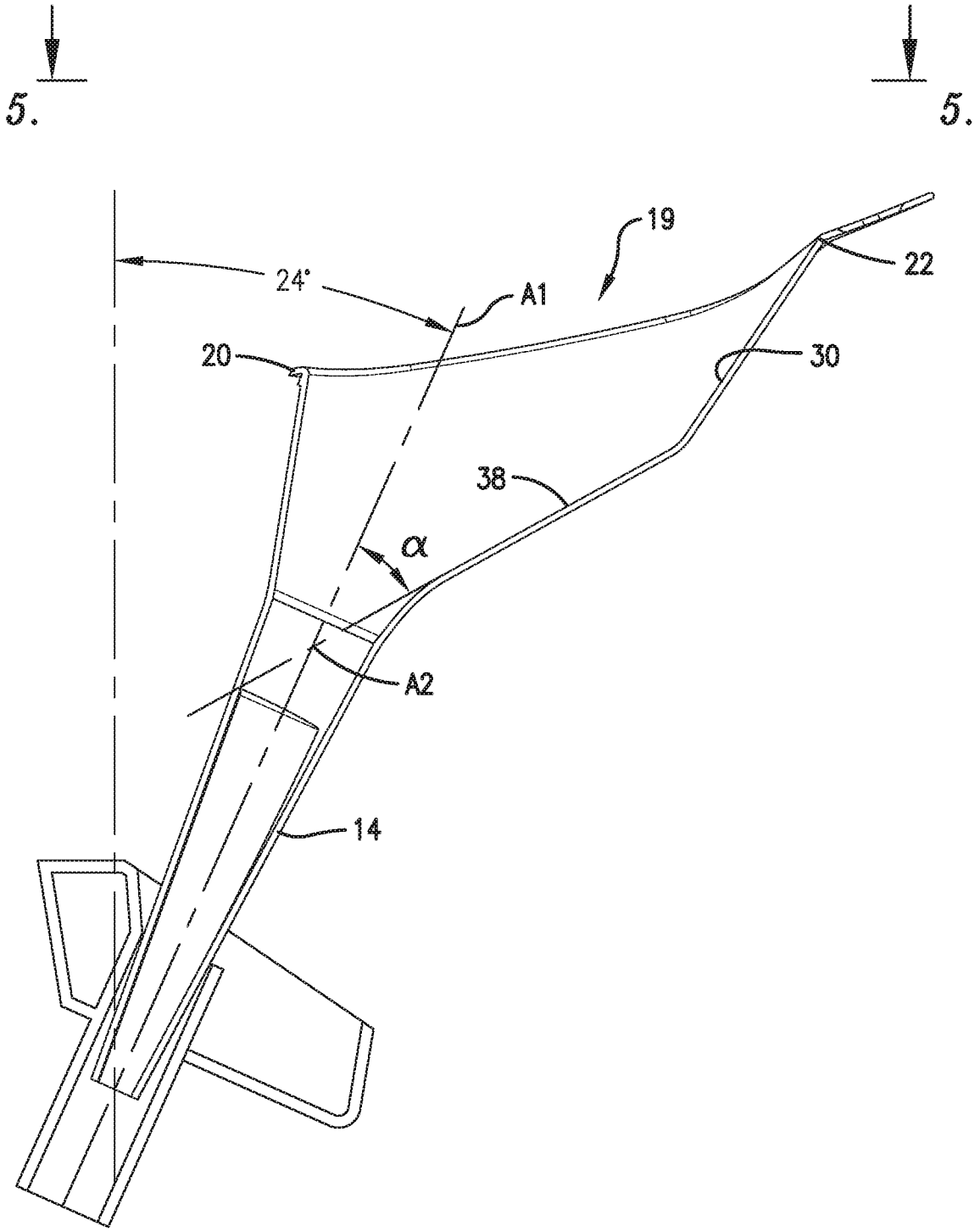
FIG. 7 is a vertical sectional view of the funnel shown inserted in a DEF port that is inclined 24 degrees relative to a vertical axis.
Figure 8:
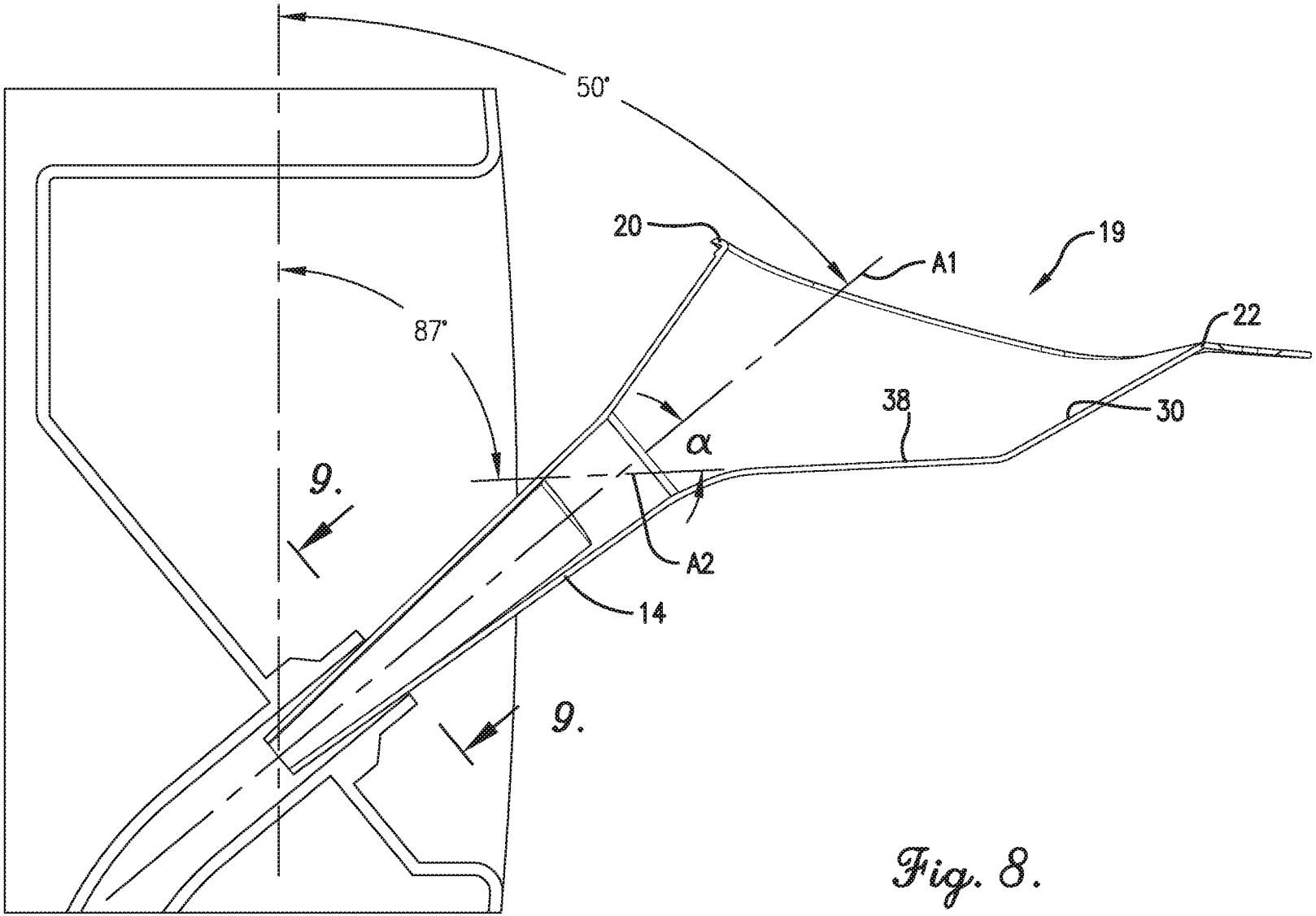
FIG. 8 is a vertical sectional view of the funnel shown inserted in a DEF port that is inclined 50 degrees relative to a vertical axis.

As best illustrated in FIG. 3, the rear rim section 22 is higher than the front rim section 20 when the funnel 10 is upright and the stem 14 extends vertically beneath the mouth 12. But when the funnel 10 is tilted as shown in FIGS. 7 and 8, the rear rim section 22 lowers relative to the front rim section 20. FIG. 7 shows the funnel 10 tilted 24 degrees, at which point the rear rim section 22 is still higher than the front rim section 20. FIG. 8 shows the funnel tilted 50 degrees, at which point the rear rim section 22 is a bit lower than the front rim section 20. At an intermediate tilt angle between those shown in FIGS. 7 and 8, the rear and front rim sections are about the same level. Thus, the effective pour-capture surface area of the mouth opening 19 increases as the funnel 10 is tilted up to a certain tilt angle to provide a larger target area for liquids. In one embodiment, the effective pour-capture area of the mouth opening 19 is maximized at nearly 17 sq. inches when the funnel is tilted approximately 40 degrees.

Figure 5:
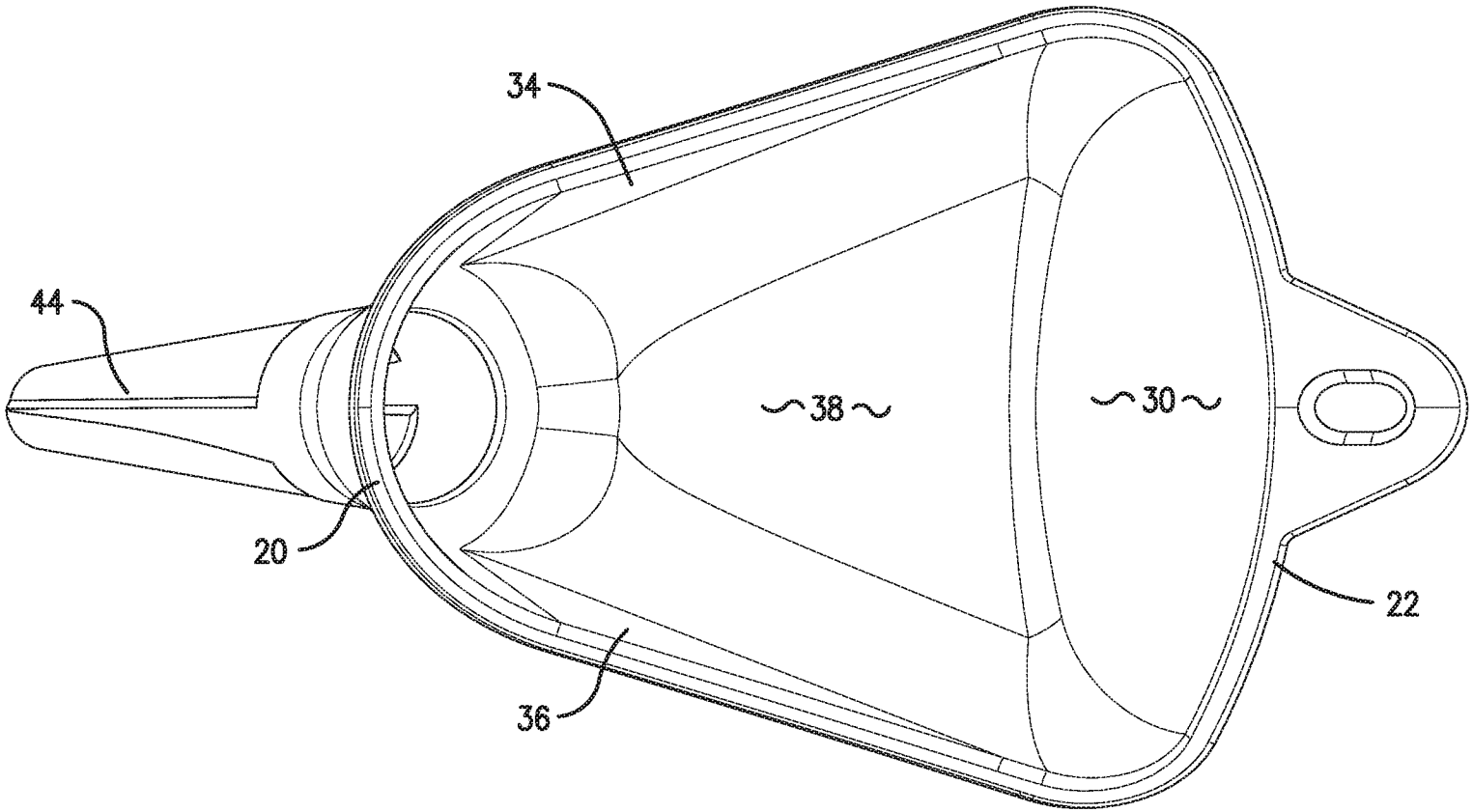
FIG. 5 is taken along lines 5-5 of FIG. 7 and shows a top view of the funnel as it appears when the funnel is tilted.
Figure 6:
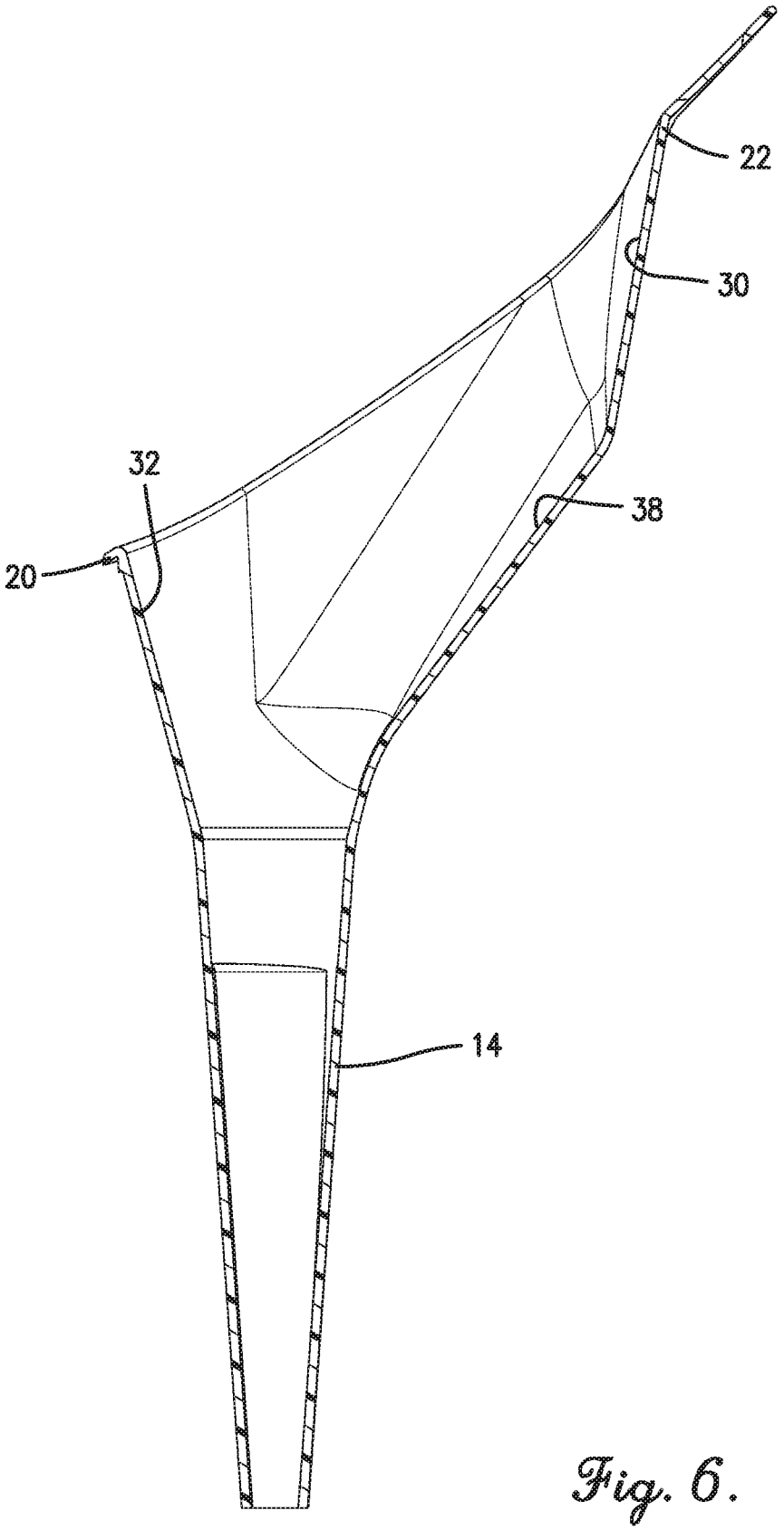
FIG. 6 is a vertical sectional view taken along line 6-6 of FIG. 4.

The shape of the mouth 12 is also selected to ease the pouring of fluids into the funnel. As best illustrated in FIG. 5, the rear rim section 22 is wider than the front rim section 20 such that the pour-capture opening 19 of the mouth is widest near the rear of the funnel. This places the largest portion of the mouth opening 19 toward the back of the funnel where liquids are typically poured, especially when the funnel is tilted.

The mouth 12 also includes a number of sloped walls that slope downwardly and inwardly away from the upper rim 18 and toward the throat 16 and the stem 14 to direct fluids from the pour capture opening 19 toward the stem. In one embodiment, the funnel includes one or more rear sloped walls 30 that connect to the rear rim section 22, one or more front sloped walls 32 that connect to the front rim section 20, one or more left side sloped walls 34 that connect to the left side rim section 24, one or more right side sloped walls 36 that connect to the right side rim section 26, and a lowermost sloped wall 38 defines the lowermost floor of the mouth 12 when the funnel 10 is tilted as shown in FIGS. 7 and 8. The funnel may also include intermediate walls that join the above-described walls.

The slope of the walls in the mouth are cooperatively configured relative to the stem 14 to ensure all fluids poured in the mouth 12 will drain into the stem 14 rather than remain in or spill out of the funnel. As shown in FIGS. 7 and 8, the stem 14 is aligned on a longitudinal axis A1, and the lowermost sloped wall 38 extends substantially on an intersecting longitudinal axis A2. In one embodiment, an interior angle $\alpha$ between the longitudinal axes A1 and A2 is no more than 40 degrees such that the lowermost sloped wall 38 is no more than 40 degrees offset from the stem 14. This ensures the lowermost sloped wall 38 slopes toward the stem 14 even when the funnel 10 is tilted. For example, when the funnel is inserted in a tank port that is inclined 24 degrees as shown in FIG. 7, or a tank port that is inclined 50 degrees as shown in FIG. 8, the lowermost sloped wall 38 still slopes toward the stem 14.

In a specific embodiment, the interior angle $\alpha$ between the longitudinal axes A1 and A2 is 37 degrees, such that the lowermost sloped wall 38 is 37 degrees offset from the stem 14. This causes the lowermost sloped wall 38 to slope 3 degrees toward the stem 14 even when the funnel 10 is tilted 50 degrees as shown in FIG. 8.

The rear sloped walls 30, front sloped walls 32, left side sloped walls 34, and right side sloped walls 36 are offset even less than 40 degrees vs. the stem 14 to hold fluids in the mouth 12 even when the funnel is tilted more than 50 degrees. In one embodiment, the rear slopped wall 30 is nearly parallel to the axis A1 such that the mouth 12 retains fluids even when the funnel is tilted nearly 90 degrees.

Figure 4:
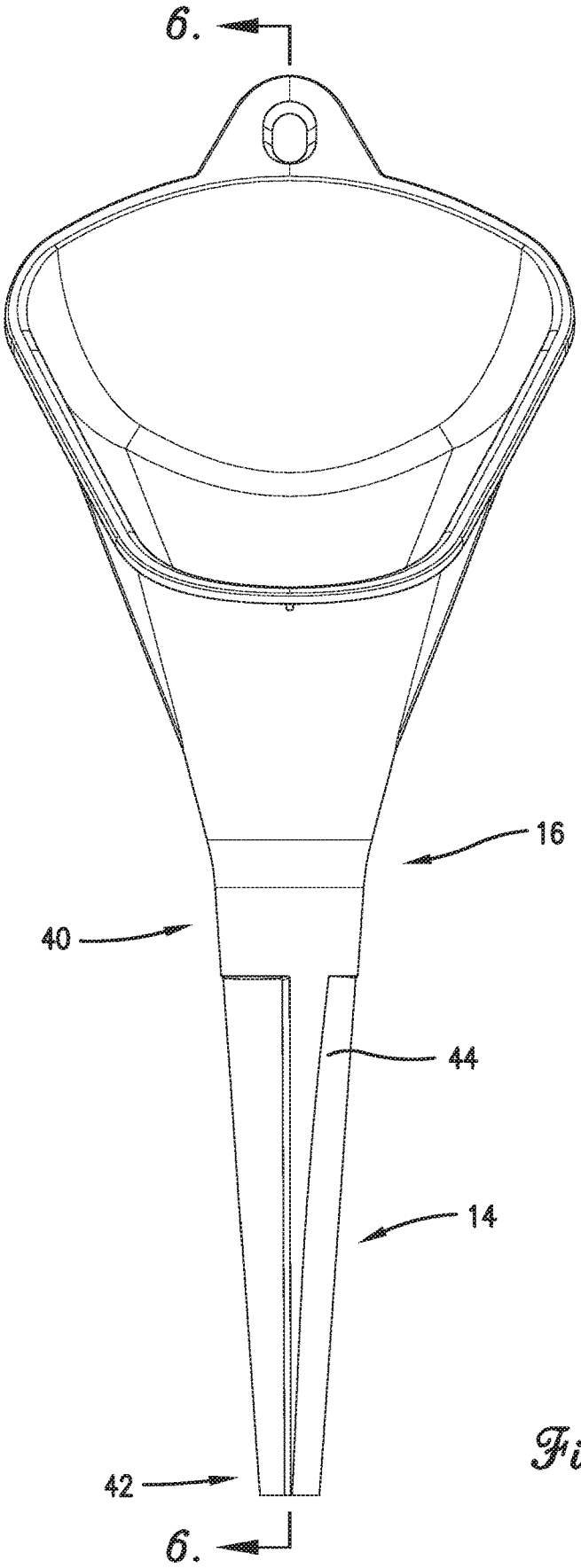
FIG. 4 is a front elevational view of the funnel.
Figure 9:
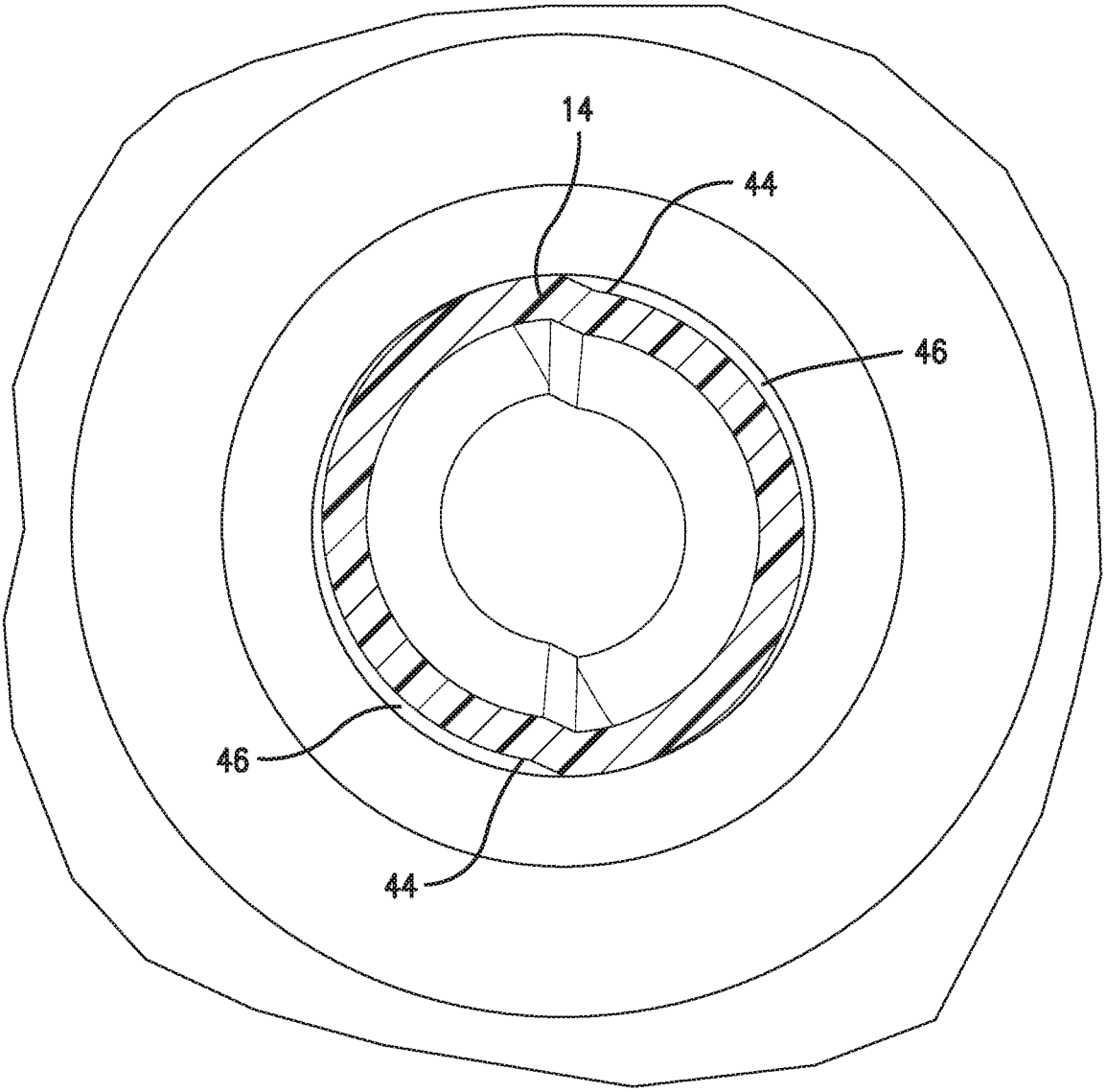
FIG. 9 is a sectional view taken along line 9-9 of FIG. 8.

Embodiments of the stem 14 will now be described with reference to FIGS. 4 and 9. The stem includes a proximal end 40 connected to the throat 16 and a distal end 42 that may be inserted in the fluid port of a tank or other receptacle. The stem 14 tapers inwardly from its proximal end 40 to its distal end 42 such that the distal end has a smaller diameter than the proximal end.

The specific taper amount of the stem 14 is optimized so that the stem can be inserted far enough into a tank port to stabilize the funnel but not so far that the mouth of the funnel is too close to the port. In one embodiment, the stem 14 is tapered such that at 1.5 inches from its tip 42, its outside diameter is 19 mm, which is the inside diameter of a standard DEF port. This allows the stem to be inserted 1.5 inches into a DEF fluid port to provide adequate anchoring of the funnel 10 in the port while also maintaining an optimal distance between the mouth of the funnel and the DEF port. This tapering also allows multiple funnels to be stacked for easier transport and storage.

The stem 14 is also designed to prevent or at least reduce bubbling of air through fluids poured in the funnel. To achieve this, grooves or slots 44 are formed in the exterior surface of the stem. These grooves form air channel 46 allow air displaced from a tank by liquids to escape around the outside of the stem rather than through DEF poured into the funnel.

The throat 16 joins the mouth 12 to the stem 14 and may be a separate portion of the funnel or may simply be an extension, or part of, the stem and/or the mouth.

By constructing a funnel as described above, numerous advantages are realized. Specifically, the funnel more effectively directs fluids into a tank, even when the funnel is tilted; inhibits fluids from backing-up into the mouth and/or spilling out of the funnel; prevents or reduces displaced air from bubbling up through fluids in the funnels; and engages and seats within tank ports in a more stable manner.

ADDITIONAL CONSIDERATIONS

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

Although the present application sets forth a detailed description of numerous different embodiments, the legal scope of the description is defined by the words of the claims set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112(f) unless traditional means-plus-function language is expressly recited, such as "means for" or "step for" language being explicitly recited in the claim(s).

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A fluid funnel comprising:

an open-topped mouth for receiving fluids, the mouth having sloped inner walls including a lowermost sloped wall with a longitudinal axis, and an upper rim including a front section, a spaced-apart rear section, and left and right side sections connected thereto and positioned therebetween, the front section having a smaller width than the rear section, and the left and right side sections angled outward to form a V shape extending from the front section to the rear section; and an elongated hollow stem connected to the mouth for directing the fluids from the mouth into a fluid port of a vehicle, the stem having a longitudinal axis that is offset 40 degrees or less from the longitudinal axis of the lowermost sloped wall of the mouth such that the lowermost sloped wall of the mouth slopes toward the fluid port when the stem is tilted up to 50 degrees relative to a vertical axis.

2. The fluid funnel as set forth in claim 1, further comprising a tapered, hollow throat that connects the mouth to the stem.

3. The fluid funnel as set forth in claim 2, wherein the stem includes a proximal end connected to the throat and a distal end for insertion in the fluid port, wherein the stem tapers inwardly from the proximal end to the distal end such that the distal end has a smaller diameter than the proximal end.

4. The fluid funnel as set forth in claim 3, wherein the stem has an outside diameter, at a distance of approximately 1.5 inches from the distal end, that is approximately equal to an inside diameter of the fluid port such that the stem extends approximately 1.5 inches into the fluid port.

5. The fluid funnel as set forth in claim 1, wherein the stem has grooves in its exterior surface for allowing air to escape from the fluid port when the stem is placed in the fluid port.

6. The fluid funnel as set forth in claim 1, wherein the mouth has a pour-capture opening having a surface area of approximately 17 square inches.

7. The fluid funnel as set forth in claim 1, wherein the fluid funnel is configured to nest within another identical fluid funnel to permit stacking of the fluid funnels.

8. The fluid funnel as set forth in claim 1, wherein the sloped inner walls of the mouth are smooth with rounded edges to reduce fluid splashing.

9. A fluid funnel for pouring diesel exhaust fluids (DEF) into a DEF port of a vehicle, the fluid funnel comprising:

an open-topped mouth for receiving the DEF, the mouth having a pour-capture opening with an effective surface area that increases as the funnel is tilted and sloped inner walls including a lowermost sloped wall with a longitudinal axis, and an upper rim including a front section, a spaced-apart rear section, and left and right side sections connected thereto and positioned therebetween, the front section having a smaller width than the rear section, and the left and right side sections angled outward to form a V shape extending from the front section to the rear section;

an elongated hollow stem for directing the DEF from the mouth into the DEF port, the stem having a longitudinal axis, an interior angle between the longitudinal axis of the lowermost sloped wall and the longitudinal axis of the elongated hollow stem is 40 degrees or less such that the lowermost sloped wall slopes toward the DEF port when the stem is tilted up to 50 degrees relative to a vertical axis; and a tapered, hollow throat that connects the mouth to the stem.

10. The fluid funnel as set forth in claim 9, wherein the stem includes a proximal end connected to the throat and a distal end for insertion in the fluid port, wherein the stem tapers inwardly from the proximal end to the distal end such that the distal end has a smaller diameter than the proximal end.

11. The fluid funnel as set forth in claim 10, wherein the stem has an outside diameter, at a distance of approximately 1.5 inches from the distal end, that is approximately equal to an inside diameter of the fluid port such that the stem extends approximately 1.5 inches into the fluid port.

12. The fluid funnel as set forth in claim 9, wherein the stem has longitudinally extending grooves in its exterior surface for allowing air to escape from the fluid port.

13. The fluid funnel as set forth in claim 9, wherein the mouth has a pour-capture opening having a surface area of approximately 17 square inches when the funnel is tilted approximately 40 degrees relative to a vertical axis.

14. The fluid funnel as set forth in claim 9, wherein the fluid funnel is configured to nest within another identical fluid funnel to permit stacking of the fluid funnels.

15. The fluid funnel as set forth in claim 9, wherein the sloped inner walls of the mouth are smooth with rounded edges to reduce fluid splashing.

16. The fluid funnel as set forth in claim 1, wherein the front rim section and the rear rim section each have an arcuate shape, and the front rim section has a radius of curvature that is smaller than a radius of curvature of the rear rim section.

17. The fluid funnel as set forth in claim 1, wherein the upper rim further includes a rear sloped wall positioned between the rear section of the upper rim and the lowermost sloped wall and connected thereto, and wherein the rear sloped wall and the lowermost sloped wall each have an axial length that are roughly equal to one another.

18. The fluid funnel as set forth in claim 9, wherein the front rim section and the rear rim section each have an arcuate shape, and the front rim section has a radius of curvature that is smaller than a radius of curvature of the rear rim section.

19. The fluid funnel as set forth in claim 9, wherein the upper rim further includes a rear sloped wall positioned between the rear section of the upper rim and the lowermost sloped wall and connected thereto, and wherein the rear sloped wall and the lowermost sloped wall each have an axial length that are roughly equal to one another.

20. A fluid funnel comprising:

an open-topped mouth for receiving fluids, the mouth having sloped inner walls including a lowermost sloped wall with a longitudinal axis, and an upper rim including a front section, a spaced-apart rear section, left and right side sections connected thereto and positioned therebetween and a rear sloped wall, the front section having a smaller width than the rear section, and the left and right side sections angled outward to form a V shape extending from the front section to the rear section, the front rim section and the rear rim section each having an arcuate shape, the front rim section having a radius of curvature that is smaller than a radius of curvature of the rear rim section, the rear sloped wall positioned between the rear section and the lowermost sloped wall and connected thereto, and the rear sloped wall and the lowermost sloped wall each having an axial length that are roughly equal to one another; and an elongated hollow stem connected to the mouth for directing the fluids from the mouth into a fluid port of a vehicle, the stem having a longitudinal axis that is offset 40 degrees or less from the longitudinal axis of the lowermost sloped wall of the mouth such that the lowermost sloped wall of the mouth slopes toward the fluid port when the stem is tilted up to 50 degrees relative to a vertical axis.

21. The fluid funnel as set forth in claim 20, wherein the front section is positioned at a higher vertical level than a vertical level of the rear section when the stem is tilted at approximately 50 degrees relative to the vertical axis.

22. The fluid funnel as set forth in claim 20, wherein the front section is positioned at a lower vertical level than a vertical level of the rear section when the stem is tilted at approximately 24 degrees relative to the vertical axis.

23. The fluid funnel as set forth in claim 20, wherein the front section is positioned at a vertical level roughly the same as a vertical level of the rear section when the stem is tilted at angle between approximately 24 degrees and approximately 50 degrees relative to the vertical axis.

24. The fluid funnel as set forth in claim 20, wherein the front section is positioned at a higher vertical level than a vertical level of the rear section when the stem is tilted at approximately 50 degrees relative to the vertical axis, the front section is positioned at a lower vertical level than a vertical level of the rear section when the stem is tilted at approximately 24 degrees relative to the vertical axis, and the front section is positioned at a vertical level roughly the same as a vertical level of the rear section when the stem is tilted at angle between approximately 24 degrees and approximately 50 degrees relative to the vertical axis.

* * * * *